United States Patent [19]

Kikuchi

[11] Patent Number: 4,838,771

[45] Date of Patent: Jun. 13, 1989

[54] BIASING FORCE ADJUSTING APPARATUS FOR ELECTROMAGNETICALLY DRIVEN RECIPROCATING PUMP

[75] Inventor: Katsuji Kikuchi, Tokyo, Japan

[73] Assignee: Nitto Kohki Co., Ltd., Tokyo, Japan

[21] Appl. No.: 201,200

[22] Filed: Jun. 1, 1988

[30] Foreign Application Priority Data

Jun. 3, 1987 [JP] Japan ..... 62-85815[U]

[51] Int. Cl.[4] ..... F04B 49/00

[52] U.S. Cl. ..... 417/417; 310/15; 92/13.1; 92/132

[58] Field of Search ..... 417/360, 417; 251/129.18; 310/15, 17; 92/13.1, 13.4, 13.7, 131, 132

[56] References Cited

U.S. PATENT DOCUMENTS

| | | | |
|---|---|---|---|
| 4,021,152 | 5/1977 | Toyoda | 417/417 |
| 4,159,105 | 4/1979 | Vander Laan et al. . | |
| 4,169,695 | 10/1979 | Masuda et al. | 417/477 X |
| 4,252,505 | 2/1981 | Toyoda | 417/417 |
| 4,272,225 | 6/1981 | Fujinaka et al. | 417/417 |
| 4,278,406 | 7/1981 | Cooperrider | 417/477 X |

FOREIGN PATENT DOCUMENTS

| | | |
|---|---|---|
| 57-32226 | 5/1982 | Japan . |
| 2121912 | 5/1984 | United Kingdom . |

*Primary Examiner*—Carlton R. Croyle
*Assistant Examiner*—Eugene L. Szczecina, Jr.
*Attorney, Agent, or Firm*—Nixon & Vanderhye

[57] ABSTRACT

A biasing force adjusting apparatus is used for an electromagnetically driven reciprocating pump in which the piston is reciprocated to achieve pumping by a magnetic force cyclically generated from an electromagnet and a biasing force of a compression coil spring. The apparatus includes a pressing mechanism having a piston-cylinder unit to which a compressor is connected. The unit is detachably connected to a spring support to press the support at a predetermined pressure, and then a fixing screw is tightened to fix the support on a housing of the pump.

3 Claims, 2 Drawing Sheets

BIASING FORCE ADJUSTING APPARATUS FOR ELECTROMAGNETICALLY DRIVEN RECIPROCATING PUMP

BACKGROUND OF THE INVENTION

1. Field of the Invention

The present invention relates to a biasing force adjusting apparatus used in an electromagnetically driven reciprocating pump comprising a housing with a cylinder, an electromagnet arranged in the housing and supplied with an AC or DC pulse current so as to cyclically repeat magnetization and demagnetization, a piston slidable in the cylinder, a magnetic member mounted in the pump so as to be attracted by an electromagnetic force generated by the energized electromagnet and to cause the piston to slide in the cylinder in one direction along the axis of the cylinder, and a biasing means for accumulating a biasing force by movement of the piston in one direction caused by magnetization of the electromagnet and for causing the pivot to slide in the cylinder in the other direction along the axis of the cylinder upon demagnetization of the electromagnet, the electromagnetically driven reciprocating pump reciprocating the piston in the cylinder so as to achieve pumping, and the biasing force adjusting apparatus being arranged to adjust the magnitude of the biasing force to a predetermined value and, more particularly, to a biasing force adjusting apparatus comprising a biasing means support member being movable relative to the housing, cooperating with the piston to clamp the biasing means in a direction for causing the biasing means to accumulate the biasing force and a direction for causing the biasing means to discharge the biasing force, and changes the clamping force by the movement thereof, and a support member position adjusting means for adjusting a position of the biasing means support member relative to the housing so that the clamping force is set at the predetermined value, thereby adjusting the magnitude of the biasing force to the predetermined value.

2. Description of the Related Art

The electromagnetically driven reciprocating pump, which has a construction described above and to which the biasing force adjusting apparatus is applied, is very popular as a compressor or a vacuum pump. Japanese Patent Publication (Kokoku) shows conventional electromagnetically driven reciprocating pump and conventional biasing force adjusting apparatus used therein.

In FIG. 1, an electromagnetically driven reciprocating pump 10 which comprises a biasing force adjusting apparatus 12 having the same construction as that of the conventional biasing force adjusting apparatus. As shown in FIG. 1, a housing of electromagnetically driven reciprocating pump 10 comprises first housing member 16 with stepped aperture 14, and second housing member 22 with aperture 20 having the same diameter as that of large-diameter portion 18 of stepped aperture 14 of first housing member 16. Second housing member 22 is fixed to first housing member 16 so as to dispose aperture 20 coaxial with large-diameter portion 18 while aperture 20 is adjacent to large-diameter portion 18 of stepped aperture 14 of first housing member 16.

A small-diameter portion of stepped aperture 14 is constituted as cylinder 24 for a piston. Piston 26 is fitted in cylinder 24 so as to be slidable along the longitudinal axis of cylinder 24. An end of cylinder 24 which is away from large-diameter portion 18 is closed by cylinder head member 28 fixed to first housing member 16. A fluid delivery port (not shown) connected to an ON/-OFF valve is formed within the area of a circumferential wall portion of cylinder 24 where the inner end face of piston 26 is moved. A second housing member 22 is opened to the atmosphere. Fluid suction port (not shown) is formed in the piston 26 to open in the inner end face (left end face in FIG. 1) and the outer end face (right end face in FIG. 1) of piston 26. Piston 26 has an ON/OFF valve for controlling a fluid flow through the fluid suction port.

Piston 26 has piston drive rod 30 coaxially extending along the central axis of stepped aperture 14 into aperture 20 of second housing member 22. An extended end portion of piston drive rod 30 is inserted in annular guide sleeve 32, formed in second housing member 22 to be coaxially with the central axis in aperture 20 of second housing member 22. The extended end portion of piston drive rod 30 is movable along this central axis in annular guide sleeve 32.

A biasing means support hole 34 is formed in the extended end portion of piston drive rod 30 so as to be opened at the end face of the extended end portion and coaxially arranged with the central axis. A biasing means is arranged in biasing means support hole 34 to bias piston 26 toward the top dead center. In this embodiment, the biasing means is constituted by compression coil 36, one end of which is in contact with the bottom surface of biasing means support hole 34.

The other end of compression coil spring 36 is supported by biasing force adjusting apparatus 12 mounted on second housing member 22.

Biasing force adjusting apparatus 12 has screw member 38 threadably engaged with second housing member 22 at a position coaxial with the central axis such that screw member 38 is movable relative to second housing member 22 along the central axis. Spring seat 40 which contacts the other end of compression coil spring 36 is pressed on through ball 42 the inner end (left end in FIG. 1) of screw member 38 which extends in an area of aperture 20 of second housing member 22 surrounded by the circumferential wall of guide sleeve 32.

Screw member 38, spring seat 40, and ball 42 constitute a biasing means support member for cooperating with biasing means support hole 34 of piston drive rod 30 of piston 26 to clamp compression coil spring 36. When a screwdriver (not shown) having a tip end of a shape corresponding to slot or cross recess 44 formed on the outer end (left end in FIG. 1) of screw member 38 extending outward from second housing member 22 is engaged with slot or cross recess 44, and is turned in one or the other direction, the biasing means support member is moved relative to second housing member 22 in a direction along the central axis to change the clamping force for coil spring 36 generated by cooperation with piston 26.

Nut 48 is threadably engaged with the outer end of screw member 38 through washer 46. Nut 48 is used to fix a position of screw member 38 relative to second housing member 22 and serves as a support member position adjusting means.

Referring to FIG. 1, piston 26 is biased toward the top dead center in biasing cylinder 24 by a preset load (a beginning load) based on the biasing force accumulated in compression coil spring 36 by biasing force adjusting apparatus 12. Iron core 50 for an electromagnet is fixed on the outer surface of first housing member 16. Coil 54 is wound around iron core 50 to cooperate with iron core 50 to constitute electromagnet 52. Coil 54 is connected to an to constitute electromagnet 52 AC power source (not shown) or a DC pulse source (not shown) so that electromagnet 52 repeats magnetization and demagnetization.

Magnetic member 56 is mounted on piston drive rod 30 of piston 26 such that piston 26 is attracted by electromagnet 52 upon energization of electromagnet 52 while piston 26 is located at the top dead center shown in FIG. 1.

In the conventional electromagnetically driven reciprocating pump having the construction described above, when magnetic member 56 is attracted by energized electromagnet 52, piston 26 is moved to the right (FIG. 1) against the biasing force of compression coil spring 36. A fluid is drawn from a fluid suction port (not shown) through an ON/OFF valve (not shown) into a working chamber formed between piston 26 and cylinder head member 28 in cylinder 24. When electromagnet 52 is deenergized, piston 26 is moved to the left (FIG. 1) toward the top dead center by the biasing force accumulated in compression coil spring 36. It is very important to set a position of the upper dead center of piston 26 in cylinder 24, and to at least collision of the head of piston 26 against a partition wall of the working chamber. When the conventional electromagnetically driven reciprocating pump 10 is used as a compressor, movement of piston 26 causes compression of the fluid in the working chamber. The fluid compressed in the working chamber is exhausted from the working chamber through the fluid delivery port (not shown) and the ON/OFF valve (not shown).

Conventional electromagnetically driven reciprocating pump 10 has a relatively large manufacturing error in performance of a biasing means constituted by, e.g., compression coil spring 36 occurs (a free length and a spring constant value of, e.g., compression coil spring 36). In order not to reflect the manufacturing error onto performance of electromagnetically driven reciprocating pump 10, the above-mentioned biasing force adjusting apparatus 12 is employed. More specifically, in the last stage of assembly of electromagnetically driven reciprocating pump 10, biasing force adjusting apparatus 12 is adjusted such that a preset load (a beginning load) applied from the biasing means (compression coil spring 36) to piston 26 is set to be a predetermined value.

However, biasing force adjustment operation by conventional screw rotational type biasing force adjusting apparatus 12 having screw member 38 and nut 48 as major members is inefficient and is incorrect because that operation is done under the operator's in tuition. That is, since the biasing force values set during biasing force adjustment cannot be directly known, variations in the magnitude of biasing forces set during adjustment are inevitably caused.

SUMMARY OF THE INVENTION

The present invention has been made in consideration of the above situation, and has as its object to provide a biasing force adjusting apparatus used in an electromagnetically driven reciprocating pump comprising a housing with a cylinder, an electromagnet arranged in the housing and supplied with an AC or DC pulse current so as to cyclically repeat magnetization and demagnetization, a piston slidable in the cylinder, a magnetic member mounted in the pump so as to be attracted by an electromagnetic force generated by the electromagnet and to cause the piston to slide in the cylinder in one direction along an axis of the cylinder, and a biasing means for accumulating a biasing force by movement of the piston in one direction caused by magnetization of the electromagnet and for causing the piston to slide in the cylinder in the other direction along the axis of the cylinder upon demagnetization of the electromagnet, the electromagnetically driven reciprocating pump reciprocating the piston in the cylinder so as to achieve pumping, and the biasing force adjusting apparatus being arranged to effectively perform biasing force adjustment of the biasing means for the electromagnetically driven reciprocating pump and to prevent variations in biasing force values (that is, a set load) set by the biasing force adjustment operation.

In order to achieve the above object of the present invention, there is provided a biasing force adjusting apparatus comprising a biasing means support member, which is movable relative to the housing, cooperates with the piston to clamp the biasing means in a direction for causing the biasing means to accumulate the biasing force and a direction for causing the biasing means to discharge the biasing force, and changes the clamping force or a preset load by the movement thereof, and a support member position adjusting means for adjusting a position of the biasing means support member relative to the housing so that the clamping force is set at the predetermined value, thereby adjusting the magnitude of a preset load to the predetermined value. The support member position adjusting means comprises pressing means which is detachably connected to the biasing means support member and freely slidable in a sliding direction of the piston and presses the biasing means support member in a region, in which the biasing means is maintained in the set load, in the direction for causing the biasing means to accumulate the biasing force, and fixing means which is mounted in the housing to fix the biasing means support member to the housing after the set load adjustment operation of the biasing means support member by the pressing means.

In the biasing force adjusting apparatus having the construction described above and according to the present invention, in the last step of assembly of the electromagnetically driven reciprocating pump, the pressing means is selectively connected to the biasing means support member, and the biasing means support member is pressed in the direction for causing the biasing means to accumulate the biasing force. After the biasing means support member is pressed by the urging means so that the set load is adjusted, the biasing means support member is fixed to the housing by the fixing means. Therefore, a set load corresponding to the predetermined force is applied to the biasing means (compression coil spring 36).

The magnitude of the pressing force generated by the pressing means can be preset, and the pressing means can accurately and repeatedly generate the pressing force of a predetermined magnitude. Therefore, biasing force adjustment operation for the biasing means of the electromagnetically driven reciprocating pump can be effectively performed, and variations in biasing forces set by the biasing force adjustment operation can be prevented.

Therefor, in a case that an oscillation system mainly consisting of the pressing means, the piston, and the biasing means for returning the piston, etc. is adjusted at its resonance frequency, at first a pressing force generated by pressing means, such as a weight or a compressor, etc., is applied to the biasing means support member while the fixing means is loosened, so that a supporting position of the biasing means is adjusted in an expansion and contraction direction of the biasing means. Next, a predetermined set load may be set in the biasing means by fixing the biasing means support member by the fixing means.

Also, therefor, a failure in the electromagnetically driven reciprocating pump, such as a failure of starting voltage, an insufficiency of a flow rate, and a production of unusual noise in a starting time and a lock pressure time, resulting from a bad influence to an operation of the electromagnetically driven reciprocating pump, the bad influence being caused by a vibration in a manufacture of the biasing means, is improved. That is, such superior technical advantages, that are increasing of stabilities of the starting voltage, the flow rate, and the quality, are produced, and therefor a productivity is also improved.

In the biasing force adjusting apparatus characterized by the above stated construction according to the present invention, it is preferable that the pressing means comprises a compressor having a piston-cylinder unit, and a piston rod assembly which is detachably connected to the biasing force support member and transmits a pressure of a pressurized fluid flown out from the compressor to the biasing means support member so as to press the bias-ing means support member in the direction for causing the biasing means to accumulate the biasing force.

The pressing means constructed as described above has a simple construction and can be easily handled.

In the biasing force adjusting apparatus characterized by the above stated construction according to the present invention, it is preferable that the fixing means includes a fixing screw which is threadably engaged with the housing so as to be movable in a direction, crossing a moving direction of the biasing means support member, relative to the housing and which presses its end face on the biasing means support member to fix the biasing means support member on the housing.

This urging means has a simple construction and can be easily handled.

DESCRIPTION OF THE PREFERRED EMBODIMENT

An embodiment of the present invention will be described with reference to FIG. 2.

Figure 1:
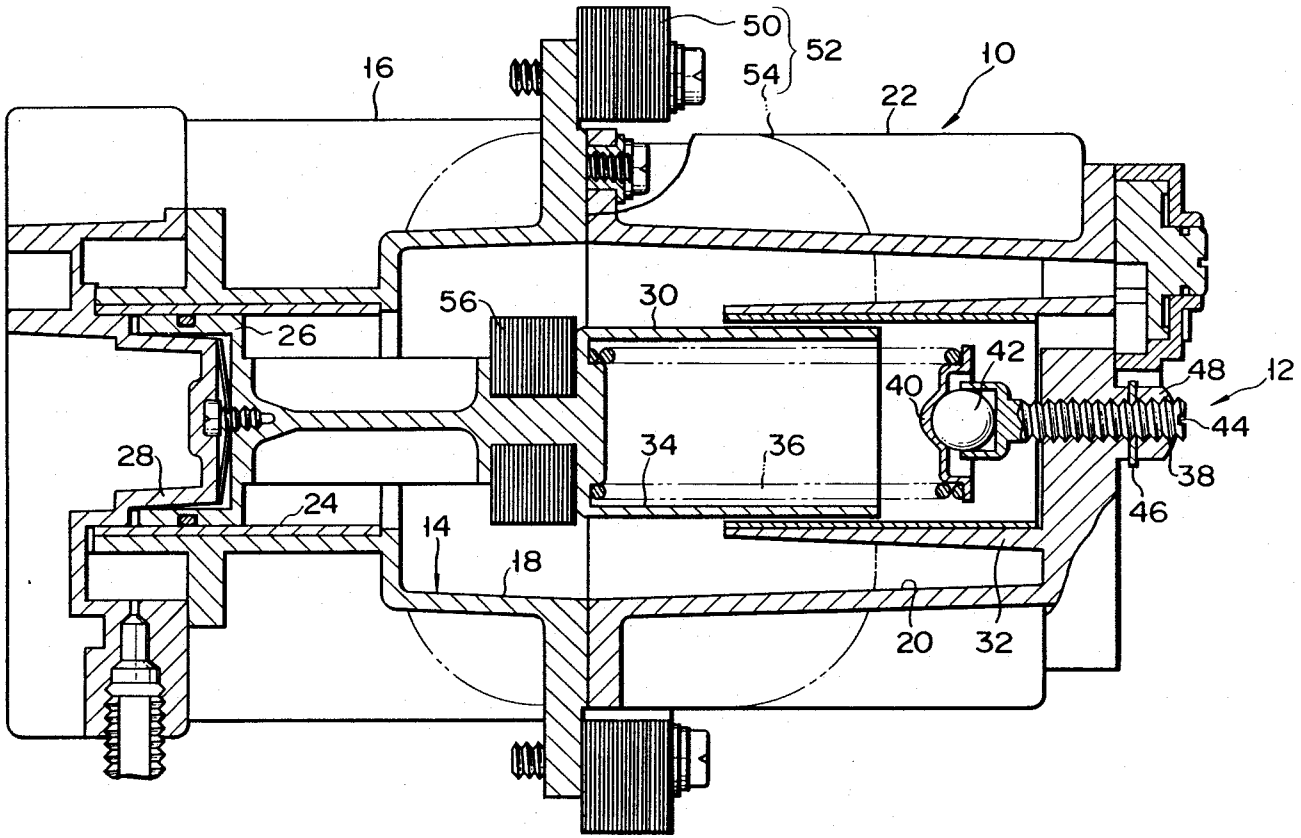
FIG. 1 (PRIOR ART)
FIG. 1 is a schematic longitudinal sectional view showing a conventional electromagnetically driven reciprocating pump employing a conventional biasing force adjusting apparatus.
Figure 2:
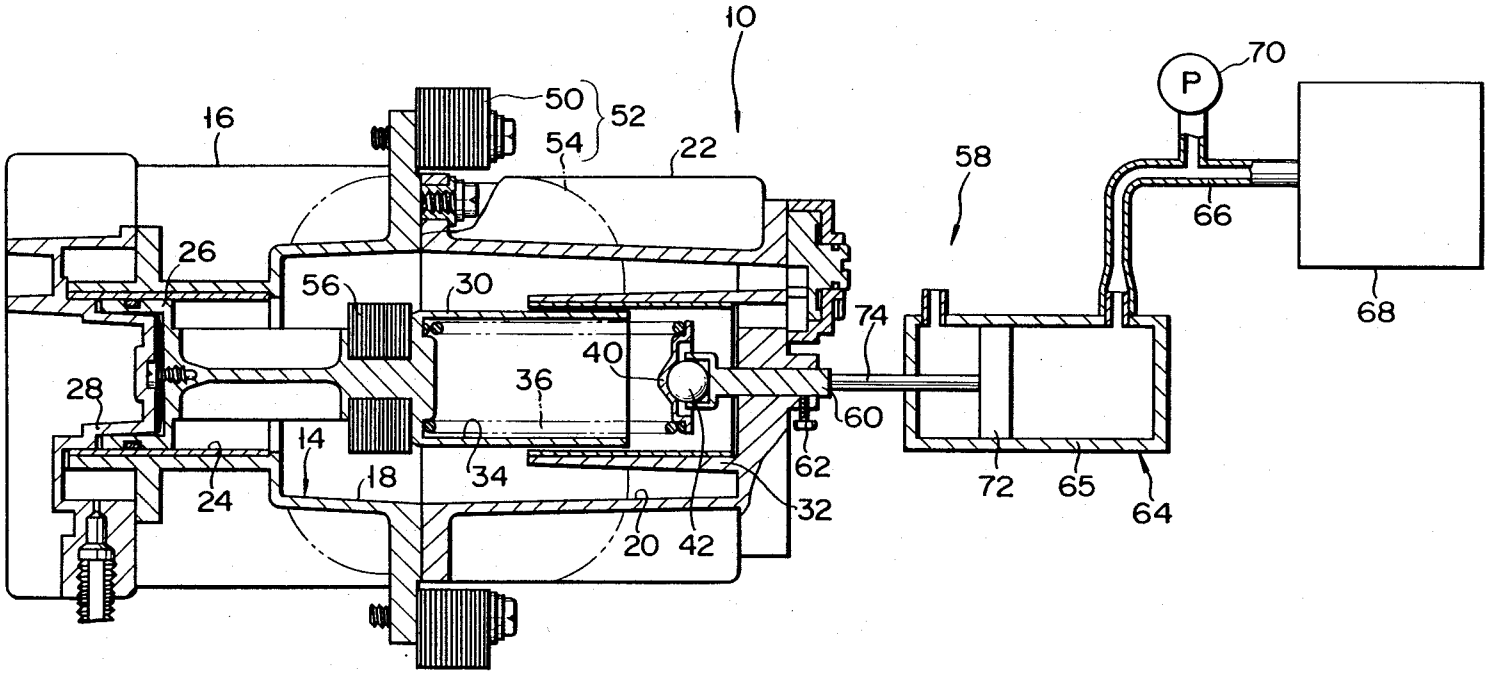
FIG. 2 is a schematic longitudinal sectional view showing an electromagnetically driven reciprocating pump employing a biasing force adjusting apparatus according to an embodiment of the present invention.

FIG. 2 is a schematic longitudinal sectional view of a conventional electromagnetically driven reciprocating pump employing biasing force adjusting apparatus 58 according to an embodiment of the present invention. The piston-cylinder unit relation of this electromagnetically driven reciprocating pump has no difference to electromagnetically driven reciprocating pump 10 shown in FIG. 1. The same reference numerals as in the conventional pump denote the same parts in the pump of this embodiment, and a detailed description thereof will be omitted.

Instead of screw member 38 in conventional biasing force adjusting apparatus 12 (FIG. 1), biasing force adjusting apparatus 58 according to an embodiment of the present invention comprises rod-like sliding member 60 which can be slid along the central axis of aperture 20 at a position coaxial with this central axis in an area of the second housing member 22 surrounded by guide sleeve 32. Spring seat 40 is supported through ball 42 at the inner end of sliding member 60 extending in the area of aperture 20 of second housing member 22 surrounded by guide sleeve 32. When sliding member 60 is reciprocally slid in a direction along the central axis, a biasing force is accumulated in and discharged from compression coil spring 36 serving as the biasing means.

Instead of nut 48 serving as the support member biasing force adjusting means in conventional biasing force adjusting apparatus 12 (FIG. 1), biasing force adjusting apparatus 58 of this embodiment comprises fixing screw 62 which is movable relative to second housing member 22 in a direction crossing to the outer peripheral surface of sliding member 60 which is slidably supported by second housing member 22. When fixing screw 62 is normally rotated in a clockwise direction, the end face of fixing screw 62 is pressed on the outer surface of sliding member 60. Therefore, sliding member 60 is fixed on second housing member 22.

Biasing force adjusting apparatus 58 according to the embodiment of the present invention further has pressing means 64 detachably connected by a known connecting means (not shown) to the outer end of sliding member 60 of the biasing means support member. Pressing means 64 comprises piston-cylinder unit 66 connected to compressor 68 through conduit 66 and a pressure regulator not shown. Pressure gauge 70 is disposed midway along conduit 66.

One end of piston rod 74 is fixed to piston 72 in piston-cylinder unit 65. The other end of piston rod 74 is detachably and coaxially connected to the outer end of sliding member 60 by a known connecting means (not shown) during the biasing force adjustment in the last of assembly for conventional electromagnetically driven reciprocating pump 10, as shown in FIG. 2. Fixing screw 62 is loosened so as to cause sliding member 60 to be slidable along second housing member 22. Thereafter, when the pressure fluid having a predetermined pressure is supplied from compressor 68 to piston-cylinder unit 64, sliding member 60 is slid at an inner portion of second housing 22 until the force for causing piston rod 74 of piston 72 of piston-cylinder unit 65 to press sliding member 60 is balanced with the biasing force accumulated in comprssion coil spring 36 serving as the biasing means of electromagnetically driven reciprocating pump 10. When an indication of pressure gage 70 reaches at a set value, fixing screw 62 is tightened to fix sliding member 60 on second housing member 22. Thereafter, the operation of compressor 68 is stopped, and then piston rod 74 of piston-cylinder unit 65 is disconnected from sliding member 60.

In the above embodiment, the other end of piston rod 74 in piston-cylinder unit 65 of pressing means 64 is detachably connected to the outer end of sliding member 60 of the biasing means support member by the known connecting means (not shown). However, the other end of piston rod 74 in piston-cylinder unit 65 of pressing means 64 need not be detachably connected to the outer end of sliding member 60 by the conventional connecting means (not shown) as far as the pressing force from piston rod 74 in the piston-cylinder unit 65 can be transmitted to sliding member 60 so as to allow pressing of sliding member 60 of the biasing means support member in a direction (left direction in FIG. 2) for causing the biasing means to accumulate the biasing force.

In electromagnetically driven reciprocating pump 10 relating to this invention, the adjustment of the set load of the biasing means to regulate the resonance frequency of the oscillation system is possible in very short time by using a simple apparatus. The tightening by fixing screw 62 which is performed after the adjustment of the set load causes the setting of the set load to be performed in a high accuracy. The setting of the set load is never influenced by a variation of the free length of compression coil spring 36.

As described above, since the set load of compression coil spring 36 can be set easily in a high accuracy, the stabilization of the flow rate in the exhausted fluid and the starting voltage, and the decreasing of the unordinary noise when the starting time and the locking time are realized.

In the above stated embodiment, pressing means for being used to adjust the set load of compression coil spring 36 is constructed by pressing means 64 which comprises compressor 68 with a regulator, pistoncylinder unit 65, and pressure gauge 70, but is not limitted to the above described construction.

What is claimed is:

1. A biasing force adjusting apparatus for an electromagnetically driven reciprocating pump comprising a housing with a cylinder, an electromagnet arranged in said housing and supplied with an AC or DC pulse current so as to cyclically repeat magnetization and demagnetization, a piston slidable in said cylinder, a magnetic member mounted in said pump so as to be attracted by an electromagnetic force generated by said energized electromagnet and to cause said piston to slide in said cylinder in one direction along an axis of said cylinder, and biasing means for accumulating a biasing force or a set load by movement of said piston in the one direction caused by magnetization of said electromagnet and for causing said piston to slide in said cylinder in the other direction along the axis of said cylinder upon demagnetization of said electromagnet, said electromagnetically driven reciprocating pump reciprocating said piston in said cylinder so as to achieve pumping by a magnetic force generated by said electromagnet and said biasing force generated by said biasing means, said biasing force adjusting apparatus comprising:

a biasing means support member, which is movable relative to said housing, cooperates with said piston to clamp said biasing means in a direction for causing said biasing means to accumulate the biasing force and a direction for causing said biasing means to discharge the biasing force and changes the clamping force or a preset load by the movement thereof; and support member position adjusting means for adjusting a position of said biasing means support member relative to said housing so that the clamping force is set at the predetermined value, thereby adjusting the magnitude of the preset load to the predetermined value, said support member position adjusting means comprising:

pressing means which is detachably connected to said biasing means support member and freely slidable in a sliding direction of the piston and presses said biasing means support member in a region, in which the biasing means is maintained in the set load in the direction for causing the biasing means to accumulate the biasing force; and fixing means which is arranged in said housing to fix said biasing means support member to said housing after the set load adjustment operation of said biasing means support member by the pressing means.

2. An apparatus according to claim 1, wherein said pressing means comprises a compressor having a piston-cylinder unit, and a piston rod assembly which is detachably connected to said biasing means support member and transmits a pressure of a pressurized fluid flown out from the compressor to said biasing means support member so as to press said biasing means support member to direction for causing said biasing means to accumulate the biasing force.

3. An apparatus according to claim 1, wherein said fixing means includes a fixing screw which is threadably engaged with said housing so as to be movable in a direction, crossing a moving direction of the biasing means support member, relative to said housing and which presses end face thereof on said biasing means support member to fix said biasing means support member on said housing.

* * * * *